US011414297B2

(12) United States Patent
Herkel et al.

(10) Patent No.: US 11,414,297 B2
(45) Date of Patent: Aug. 16, 2022

(54) ELEVATOR SAFETY DEVICE

(71) Applicant: Otis Elevator Company, Farmington, CT (US)

(72) Inventors: Peter Herkel, Berlin (DE); Mustapha Toutaoui, Berlin (DE); Ralph S. Stripling, Berlin (DE); Sven Knuth, Berlin (DE); Raphael Pecek, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 1054 days.

(21) Appl. No.: 16/043,947

(22) Filed: Jul. 24, 2018

(65) Prior Publication Data

US 2019/0031466 A1 Jan. 31, 2019

(30) Foreign Application Priority Data

Jul. 25, 2017 (EP) ..... 17183118

(51) Int. Cl.

| | |
|---|---|
| ***B66B 1/34*** | (2006.01) |
| ***B66B 1/48*** | (2006.01) |
| ***B66B 1/28*** | (2006.01) |
| ***B66B 5/00*** | (2006.01) |

(52) U.S. Cl.

CPC ..... *B66B 1/3407* (2013.01); *B66B 1/28* (2013.01); *B66B 1/3492* (2013.01); *B66B 1/48* (2013.01); *B66B 5/0056* (2013.01)

(58) Field of Classification Search

CPC ... B66B 5/0025; B66B 1/3492; B66B 5/0031; B66B 5/0018; B66B 1/28; B66B 5/0037; B66B 25/006; B66B 5/0087; B66B 5/06; B66B 1/32; B66B 5/0006; B66B 3/002; B66B 1/3407; B66B 5/044; B66B 5/16; B66B 1/343; B66B 1/48; B66B 1/34

See application file for complete search history.

(56) References Cited

U.S. PATENT DOCUMENTS

| | | | |
|---|---|---|---|
| 5,587,565 | A | 12/1996 | Schroeder-Brumloop |
| 6,701,277 | B2 | 3/2004 | Coste et al. |
| 6,874,244 | B2 | 4/2005 | Birrer et al. |
| 7,353,916 | B2 | 4/2008 | Angst |
| 7,503,434 | B2 | 3/2009 | Grundmann |

(Continued)

FOREIGN PATENT DOCUMENTS

| | | | |
|---|---|---|---|
| CN | 103449265 | A | 12/2013 |
| CN | 104986643 | A | 10/2015 |

(Continued)

OTHER PUBLICATIONS

European Search Report for application EP 17183118, dated Jan. 24, 2018, 6 pages.

(Continued)

*Primary Examiner* — Marlon T Fletcher

(74) *Attorney, Agent, or Firm* — Cantor Colburn LLP

(57) ABSTRACT

An elevator safety device (120) is configured for restricting the movement of an elevator car (106) of an elevator system (102) along its pathway in order to prevent the elevator car (106) from moving beyond at least one limit position. The elevator safety device (120) is configured for performing at least one learning run (220*a*, 220*b*) for setting the at least one limit position.

13 Claims, 3 Drawing Sheets

(56) References Cited

U.S. PATENT DOCUMENTS

| | | | | |
|---|---|---|---|---|
| 7,533,763 | B2 | 5/2009 | Kattainen et al. | |
| 7,946,393 | B2 | 5/2011 | Thum | |
| 8,997,968 | B2 | 4/2015 | Braasch et al. | |
| 9,617,115 | B2 | 4/2017 | Sarjanen et al. | |
| 2004/0173414 | A1 | 9/2004 | Deplazes et al. | |
| 2006/0118364 | A1 | 6/2006 | Birrer et al. | |
| 2012/0283870 | A1 | 11/2012 | Senger et al. | |
| 2014/0353090 | A1 | 12/2014 | Muller et al. | |
| 2015/0083528 | A1 | 3/2015 | Kattainen et al. | |
| 2015/0291390 | A1* | 10/2015 | Kakio | B66B 5/0031 187/249 |
| 2015/0314985 | A1 | 11/2015 | Schoenauer et al. | |
| 2015/0336768 | A1* | 11/2015 | Otsuka | B66B 1/36 187/394 |
| 2016/0185569 | A1* | 6/2016 | Sonnenmoser | B66B 5/0018 187/393 |
| 2016/0214832 | A1* | 7/2016 | Banno | B66B 1/3492 |
| 2018/0201477 | A1* | 7/2018 | Shibata | B66B 5/06 |
| 2019/0031466 | A1* | 1/2019 | Herkel | B66B 1/3407 |
| 2019/0389694 | A1* | 12/2019 | Herkel | B66B 5/0031 |
| 2021/0155453 | A1* | 5/2021 | Kinnari | G06N 20/00 |
| 2022/0017327 | A1* | 1/2022 | Adifon | B66B 1/3461 |
| 2022/0048732 | A1* | 2/2022 | Adifon | B66B 1/3492 |
| 2022/0048734 | A1* | 2/2022 | Adifon | B66B 1/468 |
| 2022/0073316 | A1* | 3/2022 | Adifon | B66B 1/468 |

FOREIGN PATENT DOCUMENTS

| | | | |
|---|---|---|---|
| CN | 105600627 | A | 5/2016 |
| CN | 105668360 | A | 6/2016 |
| CN | 205772537 | U | 12/2016 |
| DE | 202015105420 | | 1/2017 |
| EP | 1602610 | B1 | 4/2010 |
| EP | 2540651 | A1 | 1/2013 |
| EP | 2421787 | B1 | 7/2013 |
| EP | 2623452 | A1 | 8/2013 |
| EP | 2022742 | B1 | 6/2014 |
| EP | 2865628 | B1 | 4/2015 |
| EP | 2743225 | B1 | 2/2016 |
| EP | 2751004 | B1 | 4/2016 |
| EP | 3064463 | A1 | 9/2016 |
| EP | 3231753 | A1 | 10/2017 |
| EP | 2925653 | B1 | 4/2018 |
| JP | 2016166099 | A | 9/2016 |

OTHER PUBLICATIONS

Japanese Office Action for Application No. JP2018138955; dated May 11, 2021; 3 Pages.

Article "Nullwert" from wikipedia.org; Version from Mar. 27, 2017, 12 Pages.

European Notice of Opposition 1 for Application No. 17193118.3; dated Oct. 20, 2021; 32 Pages.

European Notice of Opposition 2 for Application No. 17183118.3; dated Oct. 20, 2021; 44 Pages.

European Notice of Opposition 3 for Application No. 17193118.3; dated Oct. 20, 2021; 49 Pages.

Excerpt from LIFTjournal May 2013, Original file name:ELG-P-03853-EPOP_E1a excerpt from LIFTjoumal 5 2013.pdf; 1 Page.

Gebrauchsanleitung LIMAX Safe SG/SC, Vers. Mar. 27, 2017, Ursprunglicher Dateiname:ELG-P-03853-EPOP_E3-Gebrauchsanleitung LIMAX Safe SG SC.pdf.

Lenzner et al., "Aufzugstechnik" ISBN 978-3-8343-3241-7, 1st edition 2011, Vogel Business Media GmbH & Co. KG, Wurzburg, pp. 155-173.

Marchesi; "Mosis -Modular Shaft Informaton System", LIFT-REPORT, May 2018, Issue 5, pp. 50-54.

Produktblatt Limax33RED, Ursprunglicher Dateiname:ELG-P-03853-EPOP_E1b- Produktblatt Limax33RED.pdf; 1 Page.

Produktblatt Limax44SAFE; Ursprunglicher Dateiname:ELG-P-03853-EPOP_E1c- Produktblatt Limax44SAFE.pdf, 2 Pages.

TUV Zertifizierung UMAX Safe SG/SC, Jan. 14, 2015, Ursprunglicher Dateiname:ELG-P-03853-EPOP_E2-TOV Zertifizierung LIMAX Safe SG SC.pdf; 2 Pages.

Unknown Author; "APS—A breakthrough in hoistway information", Brochure Cedes, V 2.0; Apr. 23, 2013, 6 Pages.

Wittur Group, "Internet excerpt on the Onyx elevator system", [foundOct. 6, 2021] Reference:[https://www.wittur.com/de/news/news-archiv/lm-liftmaterial-bringt-den-onyx-auf-den-markt.aspx] Original file name:ELG-P-03853-EPOP_E4—Internet excerpt to the onyx Elevator system.pdf, Beigetugt ais:Published-Evidence-10.pdf.

* cited by examiner

ELEVATOR SAFETY DEVICE

The invention relates to an elevator safety device which is configured for restricting movement of an elevator car within a hoistway. The invention further relates to an elevator system comprising such an elevator safety device, and to a method of initializing the elevator safety device.

Elevator systems comprising at least one elevator car moving along a pathway are usually provided with an elevator safety device which is configured for preventing the elevator car from hitting terminations at the bottom and/or top of the hoistway. The elevator safety device is also configured for preventing persons present within the hoistway from being squeezed between the elevator car and the bottom and/or top of the hoistway.

Such elevator safety devices need to be adjusted to the dimensions of the specific elevator system.

It is desirable to provide an elevator safety device which may be adjusted to the respective elevator system fast and easily.

According to an exemplary embodiment of the invention an elevator safety device for restricting movement of an elevator car of an elevator system along its pathway in order to prevent the elevator car from moving beyond at least one limit position is provided. The elevator safety device is configured for performing at least one learning run setting the at least one limit position.

Exemplary embodiments of the invention also include an elevator system comprising an elevator car, which is movable along a pathway such as a hoistway, and/or at least one guiderail, and an elevator safety device according to an exemplary embodiment of the invention which is configured for performing at least one learning run for setting the at least one limit position.

Exemplary embodiments of the invention further include a method of initializing an elevator safety device in an elevator system according to an exemplary embodiment of the invention, wherein the method comprises performing at least one learning run for setting the at least one limit position. The at least one learning run comprises the steps of moving the elevator car to a predetermined position and setting the actual position of the elevator car as a limit position.

These steps may be repeated as often as necessary for setting each of a plurality of limit positions at different positions (heights) along the pathway of the elevator car.

Exemplary embodiments of the invention allow adjusting an elevator safety device fast and easily to the respective elevator system. Due to the adjustment procedure comprising at least one learning run the same type of elevator safety device may be employed in a plurality of different elevator systems. Thus, a large number of identical elevator safety devices may be produced at low costs. Since the elevator system is configured and adjusted by self-learning, the risk of a misconfiguration due to human errors is considerably reduced.

A number of optional features are set out in the following. These features may be realized in particular embodiments, alone or in combination with any of the other features.

The elevator system may comprise a hoistway in which the elevator car is traveling. A safety device according to exemplary embodiments of the invention may be employed also in elevator systems which do not comprise a hoistway, such as "panorama" elevator systems, in which the elevator car is moving in "free space" along a wall or pillar of a building.

All these elevator systems may comprise a "normal" pit, a low pit or no pit at all (pitless elevator system), as it is usually the case in "panorama" elevator systems. In any case, the at least one limit position is set to an appropriate value in the learning run.

The elevator safety device may be configured for setting the at least one limit position as a lower limit position restricting a downward movement of the elevator car. Thus, the at least one learning run may include moving the elevator car to a predetermined position at the bottom/lower end of the pathway, and setting the actual position of the elevator car as a lower limit position.

Alternatively or additionally, the elevator safety device may be configured for setting the at least one limit position as an upper limit position restricting an upward movement of the elevator car. Thus, the at least one learning run may include moving the elevator car to a predetermined position at the top/upper end of the pathway and setting the actual position of the elevator car as an upper limit position.

The lower limit position may be set so that there is no risk that a person being present at the bottom of the pathway is squeezed between the bottom of the elevator car and a lower restriction of the pathway such as a floor or a bottom of a hoistway.

The upper limit position may be set so that there is no risk that a person being present on top of the elevator car is squeezed between the top of the elevator car and an upper restriction of the pathway such as a ceiling or a top of a hoistway.

The at least one limit position may be set to at least one preliminary value representing a preliminary limit position, which is used as a limit position as long as no learning run has been performed. The at least one preliminary limit position may correspond to a worst case scenario ensuring sufficient distance between the elevator car and the top/bottom of the pathway under all possible circumstances. In general, in the preliminary limit positions the distance between the elevator car and the top/bottom of the pathway is larger than in the limit positions resulting from the at least one learning run.

The at least one limit position may include different limit positions for normal operation and for maintenance operation of the elevator system. In maintenance operation, the limit positions may result in a larger minimum distance of the elevator car from the bottom/top of the pathway in order to avoid a person (mechanic), which is present within the pathway for performing maintenance or repair, from being hit by the elevator car.

Alternatively, as a further option, in maintenance operation, the limit positions may result in a smaller minimum distance of the elevator car from the bottom/top of the pathway in order to allow a person (mechanic) being present within the pathway/hoistway to reach the elevator car from the bottom of the pathway/hoistway and/or the top of the pathway/hoistway from the top of the elevator car for performing maintenance or repair.

The elevator safety device may be configured for performing a confirmation run for confirming the at least one limit position set in the at least one learning run. The elevator safety device in particular may be configured for repeating the at least one learning run if the at least one limit position is not confirmed in the confirmation run.

The confirmation run in particular may include: moving the elevator car along the pathway until it is stopped by the elevator safety device, comparing the actual position of the elevator car with the corresponding limit position, which usually is the closest limit position, and confirming the limit position if the difference between the actual position and the corresponding limit position is below a given tolerance. The method may further include repeating the respective learning run for resetting the corresponding limit position if the difference between the actual position and the corresponding limit position exceeds the given tolerance.

Checking and conforming the at least one limit position set in the at least one learning run enhances the safety of the elevator system, since a falsely set limit position is detected and may be corrected before the elevator system is switched to normal operation.

The confirmation run and/or the at least one learning run may be repeated in predetermined time intervals and/or after predetermined hours of operation of the elevator system in order to regularly check the previously set limit positions for maintaining a high level of safety of the elevator system.

In the following, an exemplary embodiment of the invention is described in more detail with reference to the enclosed figures.

FIG. 1 schematically depicts an elevator system comprising an elevator safety device according to an exemplary embodiment of the invention.

Figure 1:
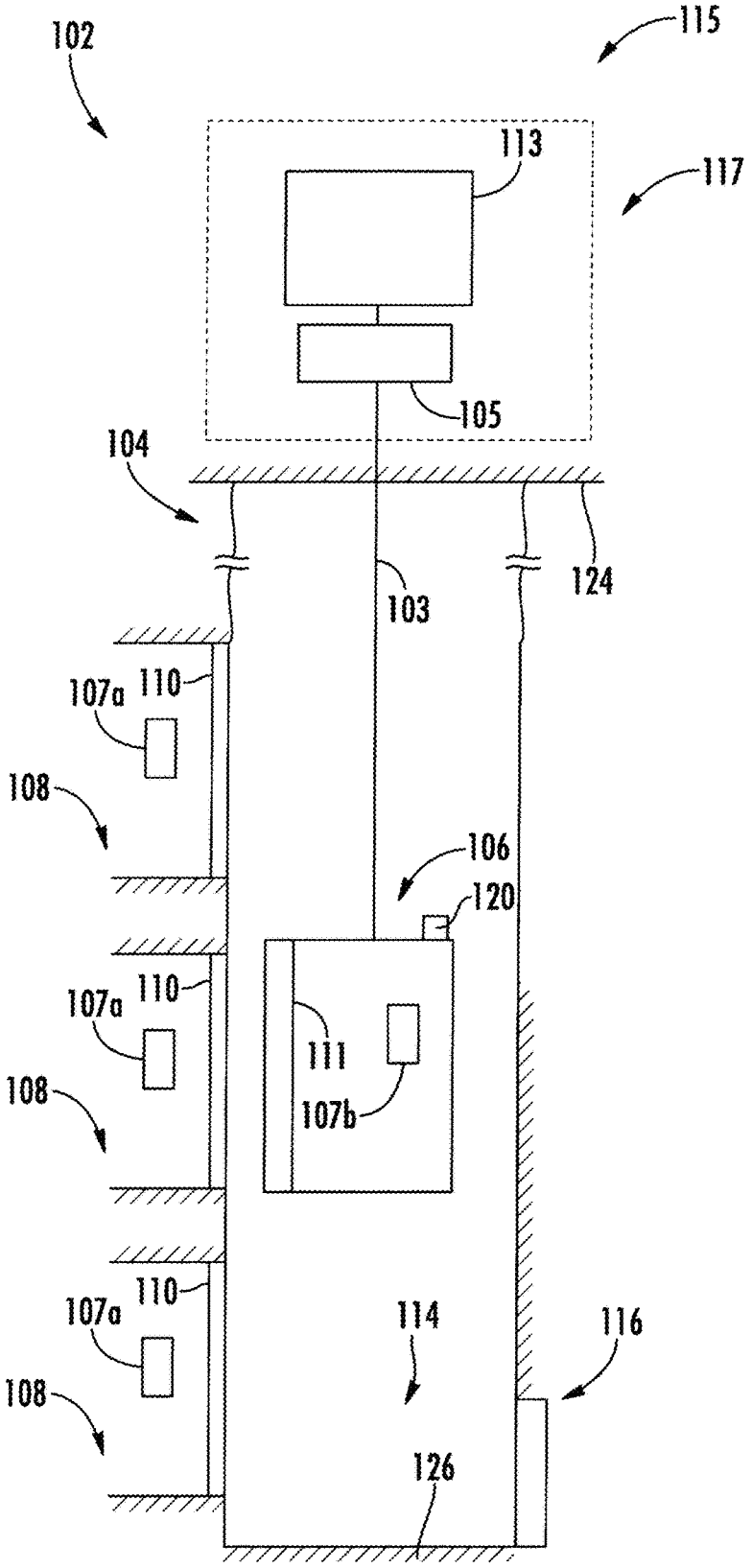
FIG. 1 depicts a schematic view of an elevator system 102 comprising an elevator safety device 120 according to an exemplary embodiment of the invention.

The elevator system 102 comprises an elevator car 106 movably suspended within a hoistway 104 extending between a plurality of landings 108, which are located on different floors. A pit 114 is provided at the bottom 126 of the hoistway 104.

The elevator car 106 is movably suspended by means of a tension member 103. The tension member 103, for example a rope or belt, is connected to an elevator drive unit 105, which is configured for driving the tension member 103 in order to move the elevator car 106 along the height of the hoistway 104 between the plurality of landings 108.

Each landing 108 is provided with a landing door 110 mounted to a landing door frame, and the elevator car 106 is provided with a corresponding elevator car door 111 for allowing passengers to transfer between a landing 108 and the interior of the elevator car 106 when the elevator car 106 is positioned at the respective landing 108.

The exemplary embodiment shown in FIG. 1 uses a 1:1 roping for suspending the elevator car 106. The skilled person, however, easily understands that the type of the roping is not essential for the invention and that different kinds of roping, e.g. a 2:1 roping, may be used as well. The elevator system 102 may use a counterweight (not shown) or not. The elevator drive unit 105 may be any form of drive used in the art, e.g. a traction drive, a hydraulic drive or a linear drive. The elevator system 102 may have a machine room 115 or may be a machine room-less elevator system. The elevator system 102 may use a tension member 103, as it is shown in FIG. 1, or it may be an elevator system without a tension member 103, comprising e.g. a hydraulic drive or a linear drive (not shown).

The elevator drive unit 105 is controlled by an elevator control unit 113 for moving the elevator car 106 along the hoistway 104 between the different landings 108.

Input to the elevator control unit 113 may be provided via landing control panels 107*a*, which are provided at each landing 108 close to the landing doors 110, and/or via a car operation panel 107*b* provided inside the elevator car 106.

The landing control panels 107*a* and the car operation panel 107*b* may be connected to the elevator control unit 113 by means of electrical lines, which are not shown in FIG. 1, in particular by an electric bus, or by means of wireless data connections.

The elevator system 102 comprises an elevator safety device 120 which is configured for restricting the movement of the elevator car 106 in order to avoid that the elevator car 106 hits against the bottom 126 or against the top 124 of the hoistway 104. The electronic elevator safety device 120 is further configured to avoid that a person 122 being present in the hoistway is squeezed between the elevator car 106 and the bottom 126 or the top 124 of the hoistway 104.

The elevator safety device 120 may be an electronic elevator safety device 120, which is mounted to the elevator car 106 and which detects the position of the elevator car 120 within the hoistway 104 by interaction with positional markers (not shown) provided within the hoistway 104. Alternatively or additionally, the elevator safety device 120 may be configured to determine the position of the elevator car 120 within the hoistway 104 autonomously, e.g. by means of speed and/or acceleration sensors monitoring the movement of the elevator car 106.

The elevator safety device 120 continuously or repeatedly determines the current position of the elevator car 106 within the hoistway 104, compares the determined position of the elevator car 106 with previously set upper and lower limits of the movement of the elevator car 106 (limit positions) and stops any further movement of the elevator car 106 if the elevator car 106 is going to exceed one of these limit positions.

The upper and lower limit positions depend on the specific configuration of the elevator system 102 and therefore need to be set individually for every specific elevator installation.

Figure 2:
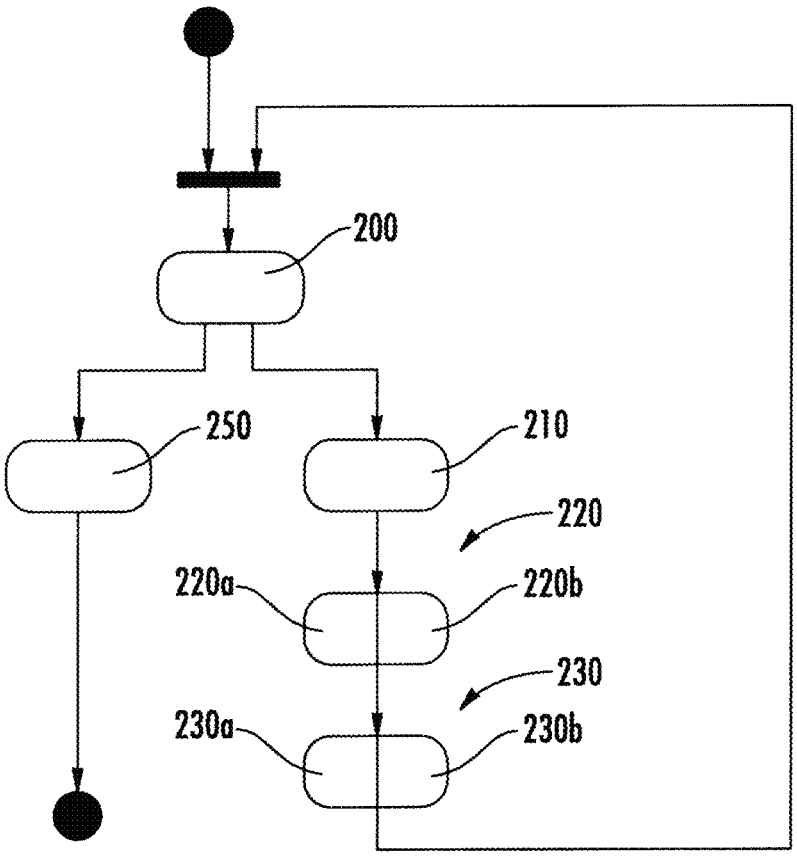
FIG. 2 is a flow diagram illustrating a method of initializing and operating an elevator safety device according to an embodiment of the invention.

A method of initializing and operating an elevator safety device 120 according to an embodiment of the invention is schematically illustrated by the flow diagram shown in FIG. 2.

In a first step 200, it is determined whether limit positions already have been set and confirmed.

If this is not the case, the limit positions are set to preliminary default values representing a preliminary limit position in step 210. The preliminary default values are unspecific, i.e. they are independent of the specific elevator system 102/elevator installation.

Thus, in order to provide the necessary safety under all possible conditions, the default values correspond to a worst case scenario providing a large margin of additional safety. As a result, the default values generally restrict the movement of the elevator car 106 more than it is necessary in the specific configuration.

Figure 3:
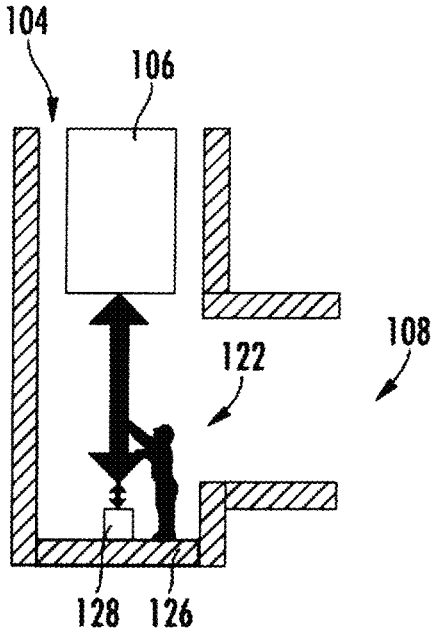
FIG. 3 illustrates the lowest possible position of the elevator car when the lower limit position is set to a default value representing a preliminary limit position.
Figure 4:
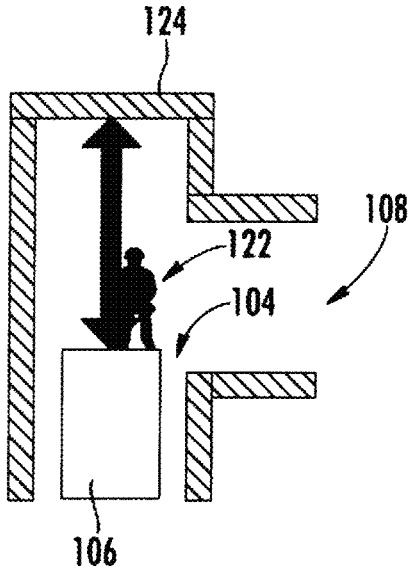
FIG. 4 illustrates the highest possible position of the elevator car when the upper limit position is set to a default value representing a preliminary limit position.

FIG. 3 illustrates the lowest possible position of the elevator car 106, when the lower limit position is set to a lower default value, and FIG. 4 illustrates the highest possible position of the elevator car 106, when the upper limit position is set to an upper default value.

As illustrated in FIGS. 3 and 4, the elevator safety device 120 reliably prevents a person 122, which is present below or on top the elevator car 106, from being squeezed between the elevator car 106 and the top 124 or the bottom 126 of the hoistway 104, when the limit positions are set to their respective default values.

However, when the limit positions are set to the default values, the elevator safety device 120 also prevents a person 122 standing at the bottom of the hoistway from reaching the bottom of the elevator car 106 (see FIG. 3) and/or from reaching the top 124 of the hoistway 104 when standing on top of the elevator car 106 (see FIG. 4). Reaching the bottom of the elevator car 106 and/or the top 124 of the hoistway 104 without using an additional tool such as a ladder, however, may be necessary or at least desirable for inspection, repair and/or maintenance of the elevator system 102.

When the limit positions are set to their respective default values, the elevator car 106 further may be prevented from reaching the uppermost and/or lowest landings 108.

Thus, according to exemplary embodiments of the invention, learning runs 220*a*, 220*b* are performed in step 220 for setting the upper and lower limit positions to their final values, which allow the elevator car 106 to reach all landings 108, in particular including the lowest and uppermost landings 108. When set to their final values, the upper and lower limit positions further should allow for convenient inspection, repair and/or maintenance of the elevator system 102 without reducing the safety of persons 122 being present within the hoistway 104 above or below the elevator car 106.

Figure 5:
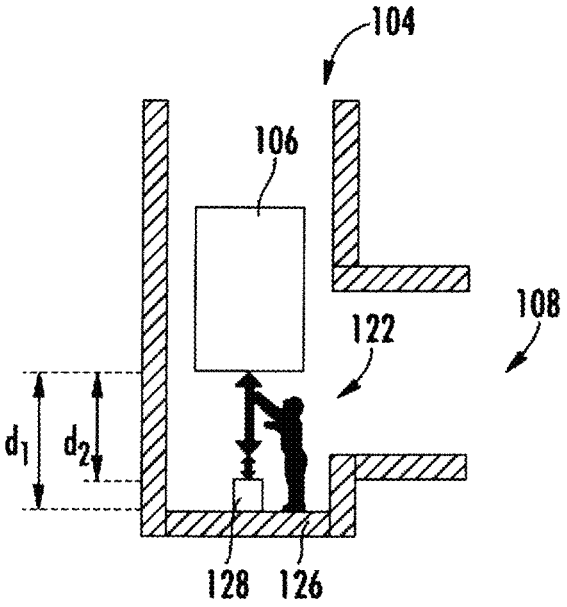
FIG. 5 illustrates the lowest possible position of the elevator car when the lower limit position is set to its final value.

In a lower learning run 220*a*, the elevator car 106 is moved by manual control into a position corresponding to a desired lower limit position, e.g. a position in which a person 122 standing at the bottom 126 of the hoistway 104 may reach the bottom of the elevator car 106 without using a ladder or a similar device (see FIG. 5).

When the elevator car 106 is located in said position, the distance d1 between the bottom 126 of the hoistway 104 and the bottom of the elevator car 106 and in particular the distance d2 between the top of a buffer 128 provided at the bottom 126 of the hoistway 104 and the bottom of the elevator cat 106 are so large that there is no risk that a person 122 being present within the hoistway 104 is squeezed between the bottom of the elevator car 106 and the buffer 128 and/or the bottom 126 of the hoistway 104.

Figure 6:
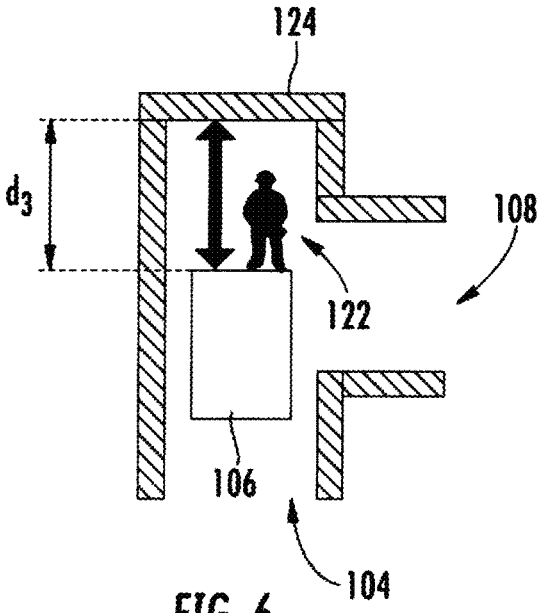
FIG. 6 illustrates the highest possible position of the elevator car when the upper limit position is set to its final value.

Similarly, in an upper learning run 220*b*, an upper limit position is set at the upper end of the hoistway 104 (see FIG. 6) when the top of the elevator car 106 is positioned in a distance d3 from the top 124 of the hoistway 104.

According to an exemplary embodiment of the invention, additional confirmation runs 230*a*, 230*b* are performed in step 230 after the upper and lower limit positions have been set in the previous learning runs 220*a*, 220*b*. This enhances the safety of the elevator system 102.

In a lower confirmation run 230*a*, the elevator car 106 is moved downwards, preferably with no person 122 being present within the hoistway 104, until the movement of the elevator car 106 is stopped by the elevator safety device 120.

The position, at which the elevator car 106 has been stopped, is compared with the corresponding lower limit position, which usually is the closest lower limit position.

If the difference between the actual position at which the elevator car 106 has been stopped and the corresponding lower limit position is smaller than a given tolerance for the lower limit position, the lower limit position is confirmed.

In case the difference between the actual position, at which the elevator car 106 has been stopped, and the corresponding lower limit position exceeds the given tolerance for the lower limit position, the lower limit position is not confirmed and the learning run 220*a* for the lower position limit is repeated.

In an upper confirmation 230*b* run the elevator car 106 is moved upwards, preferably with no person 122 being present within the hoistway 104, until the movement of the elevator car 106 is stopped by the elevator safety device 120.

The position, at which the elevator car 106 has been stopped, is compared with the corresponding upper limit position, which usually is the closest upper limit position.

If the difference between the actual position, at which the elevator car 106 has been stopped and the corresponding upper limit position is smaller than a given tolerance for the upper limit position, the upper limit position is confirmed.

In case the difference between the actual position, at which the elevator car 106 has been stopped, and the corresponding upper limit position exceeds the given tolerance for the upper limit position, the upper limit position is not confirmed and the learning run 220*b* for the upper position limit is repeated.

The given tolerance for the upper limit position may be equal to or different from the given tolerance for the lower limit position.

After the upper and lower position limits have been confirmed, the elevator system 102 is switched into its normal operation mode, in which the upward and downward movements of the elevator car 106 are restricted by the previously set and confirmed limit positions (step 250).

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

102 elevator system
103 tension member
104 hoistway
106 elevator car
107*a* landing control panels
107*b* car operation panel
108 landing
110 landing door
111 elevator car door
112 safety switch
113 elevator control unit
114 pit
115 machine room
120 elevator safety device
122 person
124 top of the hoistway
126 bottom of the hoistway
128 buffer
200 determining whether limit positions already have been set and confirmed
210 setting the limit positions to preliminary default values

220 setting the upper and lower limit positions to their final values

220*a*/220*b* lower/upper learning run

230 confirming the upper and lower limit positions

230*a*/230*b* lower/upper confirmations run d1 distance between the bottom of the elevator car and the bottom of the hoistway d2 distance between the bottom of the elevator car and a buffer at the bottom of the hoistway d3 distance between the top of the elevator car and the top of the hoistway

What is claimed is:

1. Elevator safety device (120) for restricting movement of an elevator car (106) of an elevator system (102) along its pathway in order to prevent the elevator car (106) from moving beyond at least one limit position, wherein the elevator safety device (120) is configured for performing at least one learning run (220*a*, 220*b*) for setting the at least one limit position;

wherein the elevator safety device (120) is configured for performing a confirmation run (230*a*, 230*b*) for confirming the at least one limit position set in the at least one learning run (220*a*, 220*b*)

wherein the elevator safety device (120) is configured for repeating the at least one learning run (220*a*, 220*b*) if the at least one limit position is not confirmed.

2. Elevator safety device (120) according to claim 1, wherein the elevator safety device (120) is configured for setting the at least one limit position as a lower limit position restricting a downward movement of the elevator car (106) and/or for setting the at least one limit position as an upper limit position restricting an upward movement of the elevator car (106).

3. Elevator safety device (120) according to claim 1, wherein the at least one limit position is set to at least one preliminary value before the learning run (220*a*, 220*b*) has been performed.

4. Elevator safety device (120) according to claim 1, wherein the at least one limit position includes different limit positions for normal operation and for maintenance operation of the elevator system (102).

5. Elevator system comprising:

an elevator car (106), which is movable along a pathway; and an elevator safety device (120) according to claim 1.

6. Elevator system according to claim 5, wherein the elevator system (102) is a pitless elevator system or comprises a pit (114), in particular a low pit (114).

7. Method of initializing the elevator safety device (120) in an elevator system (102) according to claim 5, wherein the method comprises performing at least one learning run (220*a*, 220*b*) for setting at least one limit position, the at least one learning run (220*a*, 220*b*) comprising the steps of:

moving the elevator car (106) to a predetermined position; and setting the actual position of the elevator car (106) as the limit position.

8. Method according to claim 7, wherein the at least one learning run (220*a*) includes:

moving the elevator car (106) to a predetermined position at the bottom of the pathway; and setting the actual position of the elevator car (106) as a lower limit position.

9. Method according to claim 7, wherein the at least one learning run (220*b*) includes:

moving the elevator car (106) to a predetermined position at the top of the pathway; and setting the actual position of the elevator car (106) as an upper limit position.

10. Method according to claim 7, wherein the method further includes:

performing a confirmation run (230*a*, 230*b*) including:

moving the elevator car (106) along the pathway until it is stopped by the elevator safety device (120);

comparing the actual position of the elevator car (106) with the corresponding limit position; and confirming the limit position if the difference between the actual position and the corresponding limit position is below a given tolerance.

11. Method according to claim 7, wherein the at least one learning run (220*a*, 220*b*) is repeated in predetermined intervals.

12. Method of initializing the elevator safety device (120) in an elevator system (102), wherein the method comprises performing at least one learning run (220*a*, 220*b*) for setting at least one limit position, the at least one learning run (220*a*, 220*b*) comprising:

moving the elevator car (106) to a predetermined position;

setting the actual position of the elevator car (106) as the limit position;

performing a confirmation run (230*a*, 230*b*) including:

moving the elevator car (106) along the pathway until it is stopped by the elevator safety device (120);

comparing the actual position of the elevator car (106) with the corresponding limit position; and confirming the limit position if the difference between the actual position and the corresponding limit position is below a given tolerance;

wherein the method includes repeating the respective learning run (220*a*, 220*b*) for resetting the corresponding limit position if the difference between the actual position and the corresponding limit position exceeds the given tolerance.

13. Method of initializing the elevator safety device (120) in an elevator system (102), wherein the method comprises performing at least one learning run (220*a*, 220*b*) for setting at least one limit position, the at least one learning run (220*a*, 220*b*) comprising:

moving the elevator car (106) to a predetermined position;

setting the actual position of the elevator car (106) as the limit position;

performing a confirmation run (230*a*, 230*b*) including:

moving the elevator car (106) along the pathway until it is stopped by the elevator safety device (120);

comparing the actual position of the elevator car (106) with the corresponding limit position; and confirming the limit position if the difference between the actual position and the corresponding limit position is below a given tolerance;

wherein the confirmation run (230*a*, 230*b*) is repeated in predetermined intervals.

* * * * *